US008203405B2

(12) United States Patent
Golz et al.

(10) Patent No.: US 8,203,405 B2
(45) Date of Patent: Jun. 19, 2012

(54) ELECTROMAGNETIC ACTUATING APPARATUS

(75) Inventors: Thomas Golz, Sipplingen (DE); Achim Riedle, Steisslingen (DE); Uwe Wagner, Volketswil/ZH (CH)

(73) Assignee: ETO Magnetic GmbH, Stockach (DE)

( * ) Notice: Subject to any disclaimer, the term of this patent is extended or adjusted under 35 U.S.C. 154(b) by 372 days.

(21) Appl. No.: 12/375,972

(22) PCT Filed: Aug. 2, 2007

(86) PCT No.: PCT/EP2007/006827

§ 371 (c)(1),
(2), (4) Date: Mar. 23, 2009

(87) PCT Pub. No.: WO2008/014995

PCT Pub. Date: Feb. 7, 2008

(65) Prior Publication Data

US 2010/0000482 A1 Jan. 7, 2010

(30) Foreign Application Priority Data

Aug. 3, 2006 (DE) ..... 20 2006 011 905 U

(51) Int. Cl.
*H01F 3/00* (2006.01)
*H01F 7/08* (2006.01)

(52) U.S. Cl. ..... 335/281; 335/229; 335/234; 335/255; 335/261; 335/262; 335/263

(58) Field of Classification Search ..... 335/229–234, 335/259, 267, 255, 261–265; 123/90.11
See application file for complete search history.

(56) References Cited

U.S. PATENT DOCUMENTS

| | | | | |
|---|---|---|---|---|
| 4,422,060 | A * | 12/1983 | Matsumoto et al. | 335/256 |
| 4,533,890 | A * | 8/1985 | Patel | 335/234 |
| 5,821,000 | A | 10/1998 | Inui et al. | |
| 5,829,688 | A | 11/1998 | Rembold et al. | |
| 6,414,406 | B1 * | 7/2002 | Ikoma et al. | 310/30 |

FOREIGN PATENT DOCUMENTS

| | | |
|---|---|---|
| DE | 2059971 | 6/1972 |
| DE | 4414168 | 10/1995 |
| DE | 20114466 | 1/2002 |
| EP | 1384886 | 1/2004 |

* cited by examiner

*Primary Examiner* — Ramon Barrera
(74) *Attorney, Agent, or Firm* — Bachman & LaPointe, P.C.

(57) ABSTRACT

An electromagnetic actuating apparatus with an elongate actuating element (3), which forms an engagement region (11) at the end and is capable of moving owing to the force of a coil device provided in stationary fashion, and sections of the actuating element have permanent magnets (4), which are designed to interact with a stationary core region (7), wherein a stationary bearing element (8) acting as a yoke is provided axially opposite the core region (7) for the actuating element (3), at least sections of which are in the form of a piston, wherein the actuating element (3) has two sections (10, 20; 3*a*, 3*b*), wherein a first section (19, 3*a*), which is arranged in the region of the permanent magnets (4), is optimized in terms of the magnetic conductivity and a second section (20, 3*b*), which is arranged in the engagement region, is optimized in terms of wear.

10 Claims, 2 Drawing Sheets

ELECTROMAGNETIC ACTUATING APPARATUS

BACKGROUND OF THE INVENTION

The invention relates to an electromagnetic actuating apparatus.

Apparatuses such as these have been known for a long time, for example as actuating apparatuses with electrical attraction magnets, and are used to fulfill a wide range of purposes. The fundamental principle is that an actuating element which is in the form of a piston and has an engagement area at the end for the intended actuating task is guided in a housing as an armature between a stationary core area and a mounting element, which acts as a yoke, and can be operated by means of an electromagnet which is provided approximately in the core area. The housing is normally designed to be permeable to magnetic flux, in order to close the magnetic circuit together with the mounting element, which acts as a yoke.

DE 102 40 774 A1 from the same applicant describes an electromagnetic actuating apparatus as claimed in the pre-characterizing clause of claim 1. In the known actuating apparatus, the actuating element is formed integrally from a soft-magnetic material. The soft-magnetic material bundles the magnetic lines of force, thus increasing the magnetic field in the area of the actuating element as a result of which it is in turn possible to achieve faster switching times. However, the known actuating apparatus has the disadvantage that the mechanical loads, which unavoidably act on the engagement area, which is likewise formed from the soft-magnetic material, of the actuating element with little strength while carrying out the movement tasks lead to increased wear on the actuating element in the engagement area.

As prior art, DE 102 40 774 A1 from the same applicant also discloses an electromagnetic actuating apparatus which is not of the same generic type and has a resetting spring instead of permanent magnet means. In this apparatus, the actuating element is formed in three pieces. The three-piece embodiment is necessary in the known apparatus in order to form an opposing bearing for the resetting spring. The central subsection of the known actuating apparatus is used as an opposing bearing.

The invention is based on the object of making an electromagnetic actuating apparatus of this generic type more robust while still having short switching times.

SUMMARY OF THE INVENTION

This object is achieved by the electromagnetic actuating apparatus having an elongated actuating element which forms an engagement area at the end and can be moved by the force of a coil device, which is provided in a stationary manner, which actuating element has permanent magnet means in places, which are designed to interact with a stationary core area, wherein a stationary mounting element, which acts as a yoke, is provided axially opposite the core area for the actuating element, which is in the form of a piston at least in places, characterized in that the actuating element has two sections, with a first section which is arranged in the area of the permanent magnet means, being optimized for magnetic permeability, and with a second section, which is arranged in the engagement area, being optimized for wear.

Advantageous developments of the invention will be made clear hereinbelow.

The invention is based on the idea of splitting the actuating element into two sections and of optimizing the first section in the area of the permanent magnet means, preferably radially within the permanent magnet means, for magnetic permeability, that is to say designing this section such that the magnetic lines of force accelerate the actuating element as much as possible and are therefore highly bundled in order to increase the magnetic field acting on the actuating element from the coil device, thus achieving actuating element accelerations that are as high as possible, and thus achieving short switching times. According to the invention, the second section of the actuating element comprises the end engagement area of the actuating element. This is not optimized for magnetic permeability but for its strength, in order to withstand the mechanical loads acting on it for as long as possible, without damage. The subdivision according to the invention of the actuating element into said two sections, of which the first section on the coil device side is optimized for magnetic permeability and the section which comprises the engagement area is optimized for its wear behavior, results in an electromagnetic actuating apparatus which on the one hand guarantees short switching times and on the other hand a long life. These characteristics are critically advantageous in particular for use of the electromagnetic actuating apparatus according to the invention in motor vehicles, for example for camshaft-travel switching or as a valve actuating apparatus.

One development of the invention advantageously provides for the second section, that is to say the section which is optimized for its wear behavior, to extend into the mounting element which acts as a yoke. Thus, according to the preferred development, not only the engagement area but also the mounting section of the actuating element is optimized for wear, and can absorb the friction forces which act on it during a translational displacement movement, without damage.

According to one preferred embodiment of the invention, the two sections of the actuating element are provided by actuating element parts which are preferably connected to one another and are composed of different materials. According to this preferred embodiment, the actuating element is not formed integrally but it is preferably formed from two pieces, with the first actuating element part on the coil device side being optimized, in particular by virtue of the choice of its material, for magnetic permeability, and with the actuating element part on the engagement area side being optimized for wear. The choice of different materials for optimization of the corresponding characteristics of the two actuating element parts is advantageous because, in general, the requirements for high magnetic permeability and high mechanical strength are diametrically opposite. The two actuating element parts preferably not only rest on one another, for example with spring force assistance, but are connected to one another such that they cannot rotate with respect to one another, in order to ensure a synchronous movement of the actuating element which is composed of the two actuating element parts.

One refinement of the invention advantageously provides that the first actuating element part is formed from soft-magnetic material, in order to achieve extreme bundling of the magnetic lines of force. Soft-magnetic materials are distinguished by the capability to magnetize them easily. In principle, both metallic and ceramic soft-magnetic materials can be used to form the first actuating element part. Ferromagnetic metals such as iron, cobalt and nickel are preferably suitable. However, ferrites based on metal oxides can also be used. In order to achieve a second actuating element part with good mechanical strength, one refinement of the invention provides that this second actuating element part be formed, for example, from austenitic material. Austenite has a cubic-area-centered structure, in which case the hardness of the austenite can be increased enormously, in particular by cold forming. Austenite is not ferromagnetic and is therefore not suitable for forming the first actuating element part.

One development of the invention advantageously provides for the two actuating element parts to be arranged adjacent to one another in the axial direction. The two actuating element parts preferably rest directly on one another. A refinement such as this is advantageous from the manufacturing point of view, since the two actuating element parts need be connected to one another only at the end.

According to one alternative, particularly robust refinement of the invention, it is advantageous for the two actuating element parts to be arranged radially rather than axially adjacent to one another. This can be achieved, for example, by the second actuating element part, that is to say the actuating element part on the engagement area side, being in the form of a sleeve which clasps the first actuating element part in places, for example by being shrunk on or pressed on. In this case, in one development of the invention, the sleeve is closed at the end in order to also protect the free end face of the actuating element against damage. If, in contrast, the second actuating element part is merely in the form of a sleeve which is open at both ends, then the engagement area of the actuating element is formed by the envelope surface, in particular by radial depressions in the envelope surface.

In order to produce a fixed, long-life connection between the two actuating element parts, one refinement of the invention provides for them to be adhesively bonded or welded to one another.

In addition or alternatively, the two actuating element parts can be connected to one another in an interlocking manner, in particular in order to ensure a connection in which they cannot rotate with respect to one another.

According to one alternative refinement of the invention, the actuating element is formed integrally rather than from two pieces. In this case, the actuating element is preferably composed of soft-magnetic material, with the second, wear-optimized section being formed by a section of the actuating element which has been hardened, in particular by heat treatment.

For wear optimization of the mounting element which acts as a yoke, one refinement of the invention provides that the permanent magnet means do not rest on the entire end face of the mounting element but that a preferably closed annular bead is provided on the end face, facing the permanent means, of the mounting element, with the annular bead acting as a stop or opposing bearing for the permanent magnet means when the actuating element is in the extended position. That end face which has the annular bead is preferably surrounded by a radially outer coaxial circumferential section of the mounting element, which is sealed on the side facing away from the permanent magnet means with respect to a support, in particular an engine block.

BRIEF DESCRIPTION OF THE DRAWINGS

Further advantages, features and details of the invention will become evident from the following description of preferred exemplary embodiments and with reference to the drawings, in which.

Identical components and components with the same function are provided with the same reference symbols in the Figures.

DETAILED DESCRIPTION

Figure 1:
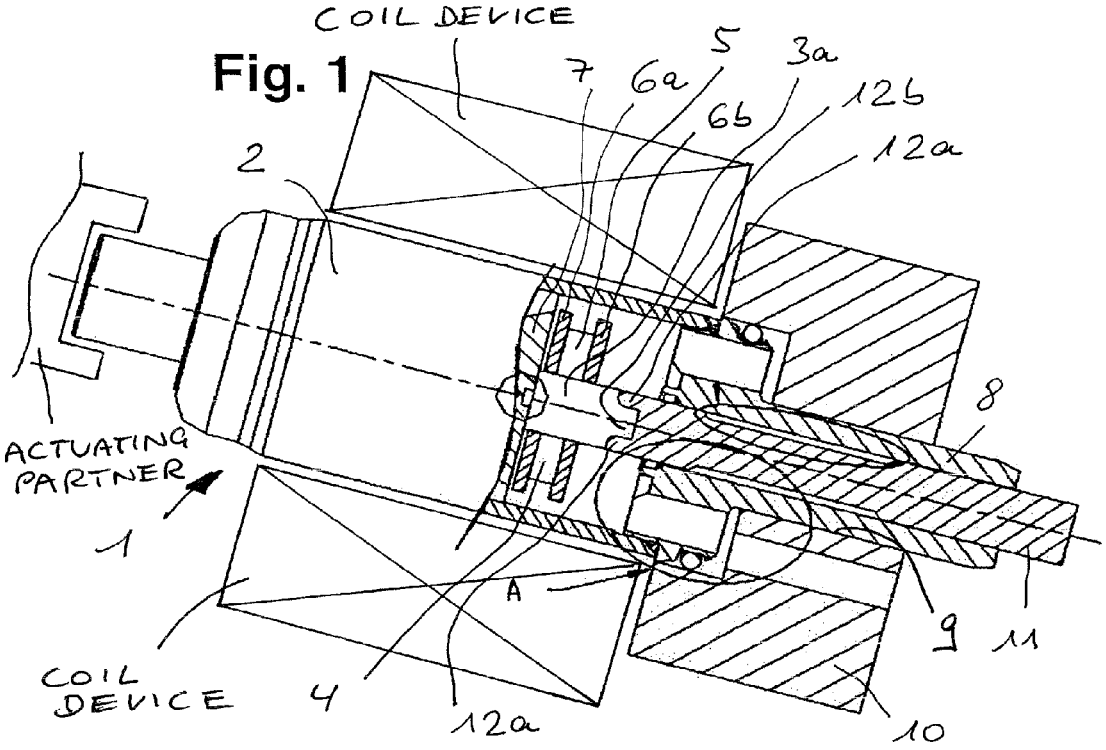
FIG. 1 shows a side, partially sectioned view of the electromagnetic actuating apparatus according to one preferred embodiment of the invention.

FIG. 1 shows an electromagnetic actuating apparatus 1 which interacts, operating it, with an actuating partner, in particular camshaft-travel switching. The electromagnetic actuating apparatus 1 comprises a hollow-cylindrical, magnetically permeable bush element 2 within which an elongated actuating element 3 in the form of a piston is arranged. The actuating element 3 passes through a permanent magnet arrangement 4 which is arranged on it such that they cannot rotate with respect to one another and comprises a central, cylindrical soft-iron disk 5 as well as permanent magnets 6*a*, 6*b*, which are arranged on both sides of it and have a larger diameter but are thinner. The actuating element 3 is guided such that it can move between a stationary core area 7 and a mounting element 8 which is in the form of a sleeve and acts as a yoke, with the mounting element 8 being guided, forming a seal, in a hollow-cylindrical recess 9, with perfect dimensions, in a support 10, for example in an engine block section.

The core area 7 is part of a coil device which is arranged within the bush element 2 in the left-hand half of the drawing and acts on the actuating element 3, in particular moving away from the core area 7, by production of a magnetic field when a current is passed through it.

As can be seen from FIG. 1, the actuating element 3, which is in the form of a piston and is guided within the mounting element 8, is formed in two parts. It comprises a first actuating element part 3*a* which is arranged in the area of the permanent magnet arrangement 4, and an axially adjacent second actuating element part 3*b* which is guided within the mounting element 8. At the end, the second actuating element part 3*b* comprises an engagement area 11, which projects out of the mounting element 8 also when the actuating element 3 is in the retracted state and acts in an actuating manner on the actuating partner, which is not illustrated. The two actuating element parts 3*a*, 3*b* are connected to one another in an interlocking manner, such that they cannot rotate with respect to one another, and are laser-welded to one another on their end faces. The interlocking connection is implemented using connecting sections 12*a*, 12*b* which engage in one another axially and via which a torque can also be transmitted in the circumferential direction between the two actuating element parts 3*a*, 3*b*. The connecting sections 12*a*, 12*b* of the actuating element parts 3*a*, 3*b* are arranged alternately in the circumferential direction.

The first actuating element part 3*a*, which is on the left on the plane of the drawing, is composed of soft iron, and the second actuating element part 3*b*, which is on the right-hand side on the plane of the drawing and surrounds the engagement area 11, is formed from cold-formed austenite and thus has high mechanical strength.

Figure 2:
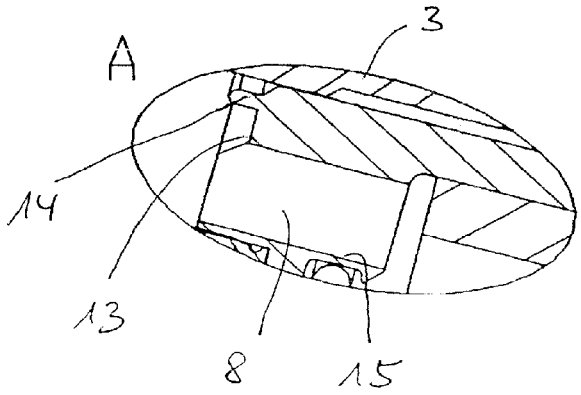
FIG. 2 shows an enlarged detail view of the detail A as shown in FIG. 1.

FIG. 2 illustrates the detail A from FIG. 1, enlarged. This shows a detail of the mounting element 8 with a circumferentially closed annular bead 14 with a rounded end face being provided on the end face 13 facing the permanent magnet arrangement 4, and with the annular bead 14 being arranged coaxially with respect to and at a radial distance from the actuating element 3 or the second actuating element part 3*b*. The extent of the annular bead 14 in the axial direction is about 3.0 mm. The annular bead 14 forms a stop or an opposing bearing for the permanent magnet 6*b* of the permanent magnet arrangement 4. The annular bead 14 is arranged radially within an outer circumferential wall 15 of the mounting element 8 and overhangs it by about 0.3 mm. The internal diameter of the circumferential wall 15 is greater than the maximum external diameter of the permanent magnet arrangement 4.

Figure 3:
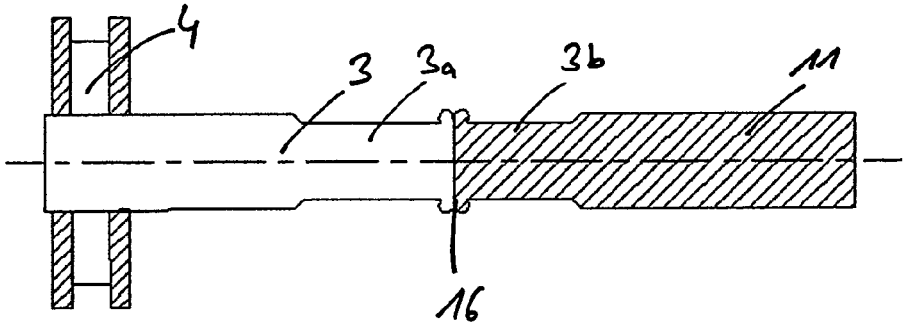
FIG. 3 shows one possible embodiment of a two-part actuating element, with the two actuating element parts being axially adjacent and being welded to one another.

FIG. 3 shows one possible further exemplary embodiment of an actuating element 3. The illustrated actuating element 3 comprises two actuating element parts 3*a*, 3*b* which are approximately of the same length, rest on one another on the end faces, and are welded to one another. In the illustrated exemplary embodiment, the contact surface 16 between the two actuating element parts 3*a*, 3*b* has a larger area than the respective axially directly adjacent section of the actuating element parts 3*a*, 3*b*. The two actuating element parts 3*a*, 3*b* are welded to one another, for example friction-welded, capacitor-discharge-welded or laser-welded. The left-hand actuating element part 3*a* on the plane of the drawing is optimized for its magnetic permeability and is formed from soft-magnetic material, with the first actuating element part 3*a* being formed such that it passes through the cylindrical permanent magnet arrangement 4. The second actuating element part 3*b* is in contrast formed from mechanically strong, hard material, such that it is optimized for its wear characteristics. The magnetic characteristics of the second actuating element part 3*b* are irrelevant, because of the long distance from the core area 7.

Figure 4:
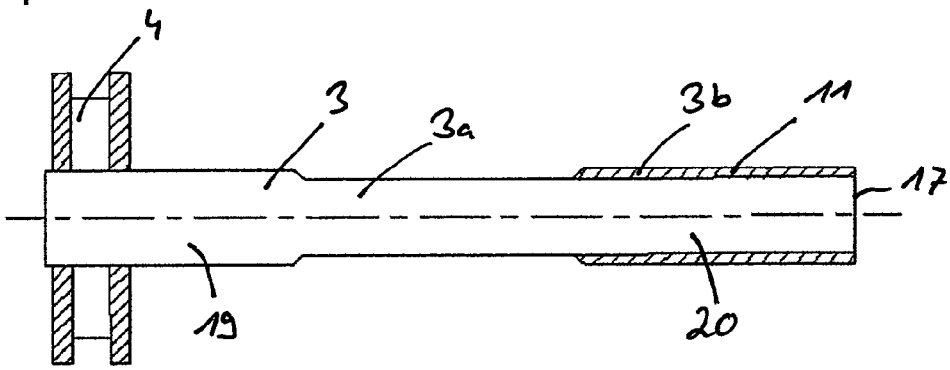
FIG. 4 shows a further possible embodiment of an actuating element, in which the actuating element is likewise formed from two parts, with the second actuating element part being stronger than the sleeve.

In the exemplary embodiment shown in FIG. 4, the first actuating element part 3*a*, which is composed of soft-magnetic material, extends over the entire axial extent of the actuating element 3. In the area of the actuating element 3 which is on the right-hand side on the plane of the drawing and surrounds the engagement area 11, a second actuating element part 3*b* is provided, which is in the form of a sleeve and is mechanically stronger, with the second actuating element part 3*b* forming the engagement area 11. The actuating element part 3*b*, which is in the form of a sleeve, is, for example, shrunk or pressed onto the first actuating element part 3*a*. Adhesive bonding is also feasible. As an alternative to the illustrated exemplary embodiment, the sleeve can also be closed at the end, in order to likewise protect the end face 17 of the actuating element 3 against mechanical loads.

Figure 5:
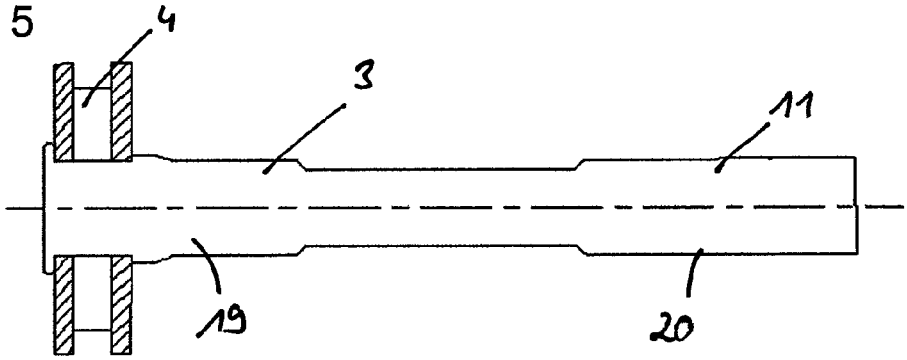
FIG. 5 shows a further exemplary embodiment of an actuating element part, which is formed integrally with two sections and the second section being mechanically stronger than the hardened area.

In the exemplary embodiment shown in FIG. 5, the permanent magnet arrangement 4 is held in an interlocking manner in the axial direction in a circumferential groove 18 in the actuating element 3. In contrast to the exemplary embodiments described above, the actuating element 3 is formed integrally, with the actuating element 3 being composed entirely of soft-magnetic material. The actuating element 3 is subdivided into a first unhardened section 19 on the permanent magnet side and a second hardened section 20, which surrounds the mounting area and the engagement area 11. The hardening of the second section 20 of the actuating element 3 means that the actuating element 3 is optimized for wear in the area within the mounting element 8 and in the engagement area 11.

Figure 6:
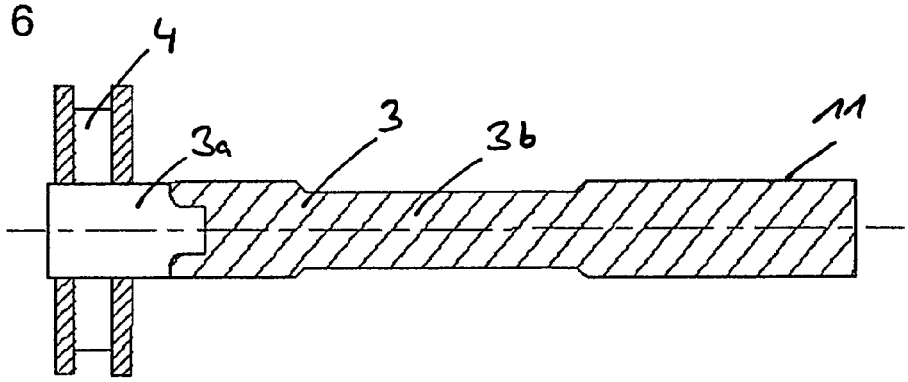
FIG. 6 shows a further exemplary embodiment of an actuating element which is formed in two pieces, with the two actuating element parts being connected to one another in an interlocking manner, as well as being adhesively bonded or welded to one another.

The exemplary embodiment shown in FIG. 6 is an enlarged illustration of the actuating element 3 as shown in FIG. 1. With regard to the details, reference is made to the description relating to FIG. 1.

The invention claimed is:

1. An electromagnetic actuating apparatus comprising:

an elongated actuating element having an engagement area at an end thereof, a stationary coil device for moving the elongated actuating element, the elongated actuating element has permanent magnet means for interacting with a stationary core area, a stationary mounting element, the mounting element is provided with a circumferentially closed annular bead on an end face thereof which faces the permanent magnet means and forms a stop for the permanent magnet means which acts as a yoke, is provided axially opposite the stationary core area for the elongated actuating element, the elongated actuating element is in the form of a piston at least in places, the elongated actuating element has two sections comprising a first section arranged in the area of the permanent magnet means and optimized for magnetic permeability, and a second section arranged in the engagement area and optimized for wear.

2. The apparatus as claimed in claim 1, wherein the second section extends into said mounting element.

3. The apparatus as claimed in claim 1, wherein the first section is formed by a first actuating element part, and the second section is formed by a second actuating element part, wherein the first and second actuating element parts are connected to one another such that they cannot rotate with respect to one another.

4. The apparatus as claimed in claim 3, wherein the first actuating element part is formed from soft-magnetic material, and the second actuating element part is formed from austenitic material.

5. The apparatus as claimed in claim 3, wherein the first and second actuating element parts are arranged axially adjacent to one another.

6. The apparatus as claimed in claim 3, wherein the second actuating element part comprises a sleeve which clasps the first actuating element part in place.

7. The apparatus as claimed in claim 3, wherein the first and second actuating element parts are bonded to one another.

8. The apparatus as claimed in claim 3, wherein the first and second actuating element parts are connected to one another in an interlocking manner.

9. The apparatus as claimed in claim 1, wherein the actuating element is formed integrally with the second section and the second section of the actuating element has been hardened by heat treatment.

10. The apparatus as claimed in claim 1, wherein the actuating element is connected to means for switching of an internal combustion engine.

* * * * *